US007059796B2

(12) United States Patent
Lewis, Jr. et al.

(10) Patent No.: US 7,059,796 B2
(45) Date of Patent: Jun. 13, 2006

(54) SELF-SEALING RETRACTABLE WRITING INSTRUMENT

(75) Inventors: Charles Richard Lewis, Jr., Palo Alto, CA (US); Kevin C. Von Essen, San Jose, CA (US); Craig Carroll, Anaheim Hills, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/417,878

(22) Filed: Apr. 17, 2003

(65) Prior Publication Data

US 2004/0042838 A1 Mar. 4, 2004

Related U.S. Application Data

(60) Provisional application No. 60/426,917, filed on Nov. 15, 2002, provisional application No. 60/386,173, filed on Jun. 4, 2002, provisional application No. 60/373,497, filed on Apr. 17, 2002.

(51) Int. Cl.
*B43K 5/16* (2006.01)

(52) U.S. Cl. ..... 401/107; 401/109

(58) Field of Classification Search ..... 401/107, 401/108, 109, 110, 11, 112, 113
See application file for complete search history.

(56) References Cited

U.S. PATENT DOCUMENTS

| | | | | |
|---|---|---|---|---|
| 261,457 | A | | 7/1882 | Hoffman |
| 1,166,896 | A | | 1/1916 | Garvey |
| 1,541,826 | A | | 6/1925 | Kroutl |
| 1,809,416 | A | | 6/1931 | Liddell |
| 2,582,451 | A | | 1/1952 | Mureau |
| 2,874,679 | A | | 2/1959 | Zepelovitch |
| 2,957,452 | A | | 10/1960 | Brannon |
| 3,035,299 | A | | 5/1962 | Gordon et al. |
| 3,039,436 | A | | 6/1962 | Exner |
| 3,191,329 | A | * | 6/1965 | Shea ..... 40/334 |
| 3,479,122 | A | | 11/1969 | Funahashi |
| 3,480,370 | A | | 11/1969 | Koeln |
| 3,525,573 | A | * | 8/1970 | Fend ..... 401/108 |
| 3,583,820 | A | | 6/1971 | Koeln |
| 3,594,091 | A | | 7/1971 | Bleuer |
| 3,709,619 | A | | 1/1972 | Zepell |
| 3,652,172 | A | | 3/1972 | Zepell |
| 3,652,173 | A | | 3/1972 | Miller et al. |
| 3,905,709 | A | | 9/1975 | Bok |
| 3,922,100 | A | | 11/1975 | Saito |

(Continued)

FOREIGN PATENT DOCUMENTS

| | | |
|---|---|---|
| CH | 612885 | 8/1976 |

(Continued)

*Primary Examiner*—David J. Walczak

(57) ABSTRACT

A retractable writing instrument that substantially prevents writing fluid from evaporating through the tip when the tip is in a retracted position to eliminate the need for a cap. Within the writing instrument is an enclosure member that has a vapor chamber. In the retracted position, the tip of the writing instrument is within the vapor chamber to substantially seal the tip from ambient air so that writing fluid does not evaporate through the tip. The enclosure member has a lip that opens to allow the tip to move forward and extend from the writing instrument so that writing fluid can be delivered to the writing surface for writing. When the tip is moved back into the retracted position the lip closes to substantially seal the tip from the ambient air. An external compression force may be applied to the lip to assist in sealing the lip. The enclosure member may be made of a material that is durable so that the lip does not wear out after many cycles of moving the tip between the retracted and protracted positions, such as silicone, butyl rubber, and thermoplastic vulcanizate (TPV) material including butyl rubber cross-linked with polypropylene.

52 Claims, 9 Drawing Sheets

U.S. PATENT DOCUMENTS 3,941,490 A * 3/1976 Anton ..... 401/110
3,945,734 A * 3/1976 Woodbridge ..... 401/198
3,993,409 A 11/1976 Hart
4,218,154 A 8/1980 Erfer
4,269,525 A 5/1981 Melikian
4,469,462 A 9/1984 Hashimoto et al.
4,470,715 A 9/1984 Reuchlin
4,479,732 A 10/1984 Shimizu
4,496,258 A 1/1985 Tanaka et al.
4,509,541 A 4/1985 Manciocchi, Jr.
4,540,300 A 9/1985 Midorikawa
4,544,297 A 10/1985 Grossiord
4,556,336 A 12/1985 San et al.
4,560,298 A 12/1985 Oki et al.
4,572,688 A 2/1986 Klose
4,588,319 A 5/1986 Neimeyer
4,618,280 A 10/1986 Kageyama
4,624,594 A 11/1986 Sasaki et al.
4,629,348 A 12/1986 Hashimoto et al.
4,640,637 A 2/1987 Winthrop
4,696,594 A 9/1987 Powers
4,711,592 A 12/1987 Gregory
4,712,937 A 12/1987 Schmidt et al.
4,741,437 A 5/1988 Gorski et al.
4,759,650 A 7/1988 Granoff
4,768,529 A 9/1988 Mahruki
4,854,759 A 8/1989 Morane et al.
4,902,152 A 2/1990 Seidler
4,911,570 A 3/1990 Rhoades
4,923,317 A 5/1990 Bishop et al.
4,929,107 A 5/1990 Kageyama et al.
4,969,764 A 11/1990 Gregory
4,969,766 A 11/1990 Nagle et al.
5,004,362 A 4/1991 Palmer
5,017,034 A 5/1991 Stary et al.
5,022,773 A * 6/1991 Waldinger et al. ..... 401/107
5,048,990 A 9/1991 Hashimoto et al.
5,067,837 A 11/1991 Panopoulos
5,087,144 A 2/1992 Wada et al.
5,092,701 A 3/1992 Lai
5,095,580 A 3/1992 Capponi
5,102,251 A 4/1992 Kaufmann
5,131,774 A 7/1992 Katz
5,149,219 A 9/1992 Kageyama et al.
5,163,767 A 11/1992 Lucas
5,171,097 A 12/1992 Nagaoka et al.
5,174,814 A 12/1992 Burwell et al.
5,192,154 A 3/1993 Moeck
5,207,523 A 5/1993 Wittek
5,213,236 A 5/1993 Brown et al.
5,339,995 A 8/1994 Brown et al.
5,362,168 A 11/1994 Abe et al.
5,377,877 A 1/1995 Brown et al.
5,397,195 A 3/1995 Goncalves
5,407,448 A 4/1995 Brandt et al.
5,445,466 A 8/1995 Mukunoki
5,480,250 A 1/1996 Birden
5,482,191 A 1/1996 Kaufmann
5,641,078 A 6/1997 Kaufmann
5,735,623 A 4/1998 Gueret
5,823,697 A 10/1998 Talbot
5,895,162 A 4/1999 Gueret
5,915,867 A 6/1999 Hashimoto
5,951,185 A 9/1999 Kingsford et al.
6,010,266 A 1/2000 Schrepf
6,033,141 A 3/2000 Blaustein et al.
6,050,445 A 4/2000 Manganiello
6,095,706 A 8/2000 Hashimoto
6,135,660 A 10/2000 Stevens et al.
6,158,913 A 12/2000 Dumler
RE37,016 E 1/2001 Morano
6,174,099 B1 1/2001 Patel et al.
6,213,661 B1 4/2001 Coon
6,231,256 B1 5/2001 Kingsford
6,231,257 B1 5/2001 Stevens
6,321,620 B1 11/2001 Fabbro
6,321,931 B1 11/2001 Hakim et al.
6,371,129 B1 4/2002 Le Bras-Brown
6,402,409 B1 6/2002 Park
6,478,495 B1 11/2002 Ami et al.
6,530,709 B1 3/2003 Washington
6,588,958 B1 7/2003 Seidler
6,718,990 B1 4/2004 Chastain et al.
2002/0039511 A1 4/2002 Park
2002/0131807 A1 9/2002 Ami et al.

FOREIGN PATENT DOCUMENTS

DE 1269010 9/1969
DE 1461588 12/1969
DE 1561812 4/1970
DE 1561813 4/1970
DE 1561814 4/1970
DE 1561830 4/1970
DE 2124298 5/1971
DE 2424918 A1 12/1975
DE 2752304 7/1978
DE 2808910 A1 6/1979
DE 2844886 A1 8/1979
DE 3342141 A1 5/1984
DE 3434378 C1 9/1984
DE 3433393 A1 3/1986
DE 3434188 A1 3/1986
DE 3502592 7/1986
DE 3504462 A1 8/1986
DE 19930540 A1 6/1989
DE 3916343 C1 10/1990
DE 4025090 A1 2/1991
DE 4305082 A1 2/1993
DE 4403771 A1 2/1994
DE 19610644 A1 9/1997
DE 29823054 U1 7/1999
DE 19943360 A1 3/2000
DE 29910459 U1 11/2000
EP 0063658 A1 11/1982
EP 0210300 A1 12/1985
EP 0267557 A1 5/1988
EP 0461292 A1 6/1990
EP 0452281 A1 10/1991
EP 0678075 B1 4/1997
FR 1424491 12/1965
JP 1280596 A 11/1989
JP 1281999 11/1989
JP 2283499 11/1990
JP 04316899 A2 11/1992
JP 08108677 4/1996
JP 08216586 A2 8/1996
JP 8300872 11/1996
JP 8318693 12/1996
JP 08318693 A 12/1996
JP 08337089 A 12/1996
JP 09131994 A 5/1997
JP 10100579 4/1998
JP 10114187 5/1998
JP 10114188A32 5/1998
JP 2002187395 A 7/2000
JP 2001063271 A2 3/2001
JP 2002178681 6/2002
WO WO8502149 5/1985
WO WO-9000118 1/1990
WO WO-00/17575 3/2000
WO WO03068530 A2 8/2003

* cited by examiner

FIG. 9
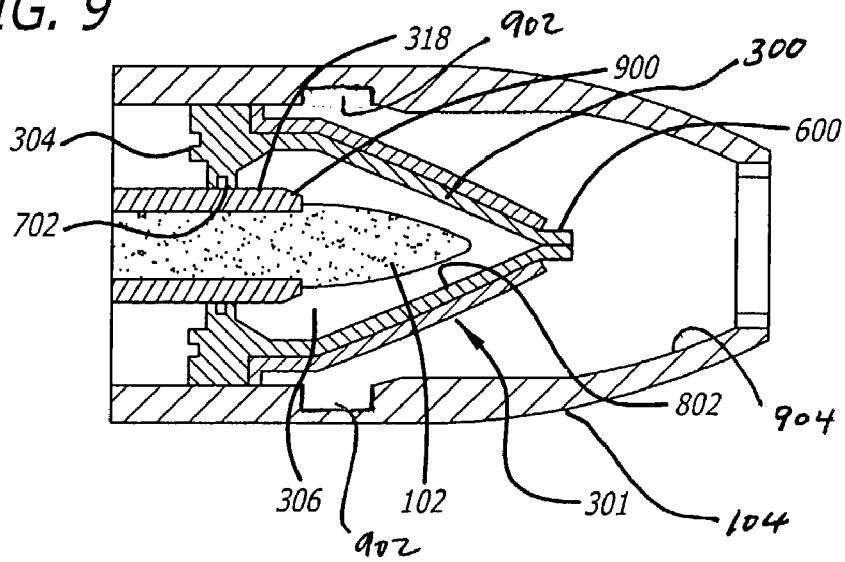
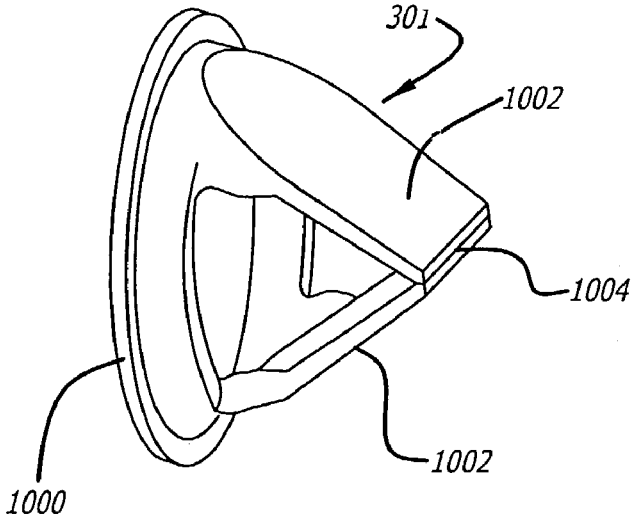
FIG. 10
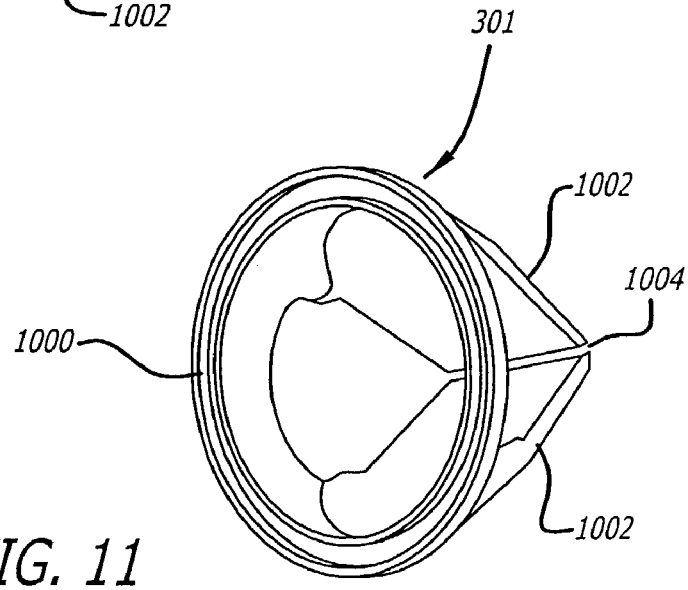
FIG. 11

SELF-SEALING RETRACTABLE WRITING INSTRUMENT

CROSS-REFERENCES TO RELATED APPLICATIONS

This application claims the benefit of three Provisional Patent Applications: (1) Ser. No. 60/373,497, filed Apr. 17, 2002; (2) Ser. No. 60/386,173, filed Jun. 4, 2002; and (3) Ser. No. 60/426,917, filed Nov. 15, 2002, all entitled "Self-Sealing Retractable Writing Instrument," which are all incorporated by reference.

BACKGROUND OF THE INVENTION

Field of the Invention

This invention relates to writing instruments, and more particularly to writing instruments that dispense volatile inks, such as felt tip markers and the like.

DESCRIPTION OF RELATED ART

This invention relates to ink impregnated marking and writing instruments, commonly known as "markers." The term "markers" as used herein generally includes all such writing instruments where ink may have a tendency to evaporate from its tip. Some examples of markers include, but not limited to, felt-tipped pens, dry erase, permanent and non-permanent markers, and children's markers. Markers have at least one end with a writing tip for writing onto a surface. The writing tip is also referred to as a nib. The ink formulations typically comprise dye and solvent in which the dye is dissolved. These ink solvents are typically volatile, being prone to evaporation when exposed to ambient air. If a sufficient amount of the ink solvent evaporates from the writing tip of the marker, the writing tip dries out, and the performance of the marker substantially degrades.

The problem with ink evaporating from the tip is solved by placing a cap over the tip when the marker is not in use. One of the problems with the cap is that the cap is often not put back on the tip after its use because users sometimes forget to put the cap back on or it is misplaced, and without the cap, the tip dries out to shorten the life of the marker.

To overcome the problem of having a cap for the marker, some markers are designed with a self-sealing cap integrated into the maker housing. These markers have their own problems in that the self-sealing cap designs are complex and do not work very well. One of the problems is that the writing tip is typically isolated in a relatively large air chamber when the writing instrument is not in use. With a large air chamber, a large amount of ink can still evaporate into the air chamber. Another problem is that as the tip moves in and out of the self-sealing cap there is friction between the self-sealing cap and the tip that can cause the self-sealing cap to deteriorate over time. In addition, the assembly of self-sealing caps is complex so that they may be unsuitable for high volume manufacturing processes. Therefore, there is a need for an improved self-sealing writing instrument.

SUMMARY OF THE INVENTION

This invention provides a retractable writing instrument that substantially prevents writing fluid from evaporating through the tip when the tip is in a retracted position. The retractable writing instrument includes a front barrel with a front opening to allow the tip to move in and out of the opening. Adjacent to the front opening and within the front barrel is an enclosure member that substantially seals the tip from outside air when the tip is in a retracted position. The writing instrument also includes a back barrel with a back opening. Disposed within the back opening is a plunger that is adapted to move back and forth axially. When the plunger is activated by clicking on it, for example, the tip may be moved in and out of the enclosure member and front opening. Writing fluid is stored in a feeder. A nib is between the feeder and the tip to convey the writing fluid in the feeder to the tip. The nib may be unitary with the tip or may be a separate component. At least a portion of the feeder may extend into the back opening and into the plunger to lengthen the size of the feeder to store more writing fluid.

The enclosure member includes a first end and a second end, where the first end is adapted to open to allow the tip to extend through the first end. To open, the first end may have a lip with a slit. To further assist in substantially sealing the lip in the retracted position, a clip may be provided to add compression force to the lip. The second end may have an inner configuration adapted to substantially seal the second end of the enclosure member yet allow the tip to move axially in and out when activated by the plunger. In the retracted position, the tip is between the first and second ends to substantially seal the tip from the ambient air, thereby eliminating the need for a cap.

The enclosure member may be made of a material that is durable so that the lip does not wear out after many cycles of moving the tip in and out of the enclosure member. The material should be also impermeable vapor to seal the tip from the ambient air. In this regard, the enclosure member may be made of thermoplastic vulcanizate (TPV) material including butyl rubber cross-linked with polypropylene.

Other systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 9 is cross-sectional view of an alternative writing side of a writing instrument.

FIG. 10 is a front perspective view of a clip.

FIG. 11 is a rear perspective view of the clip.

DETAILED DESCRIPTION

Figure 1:
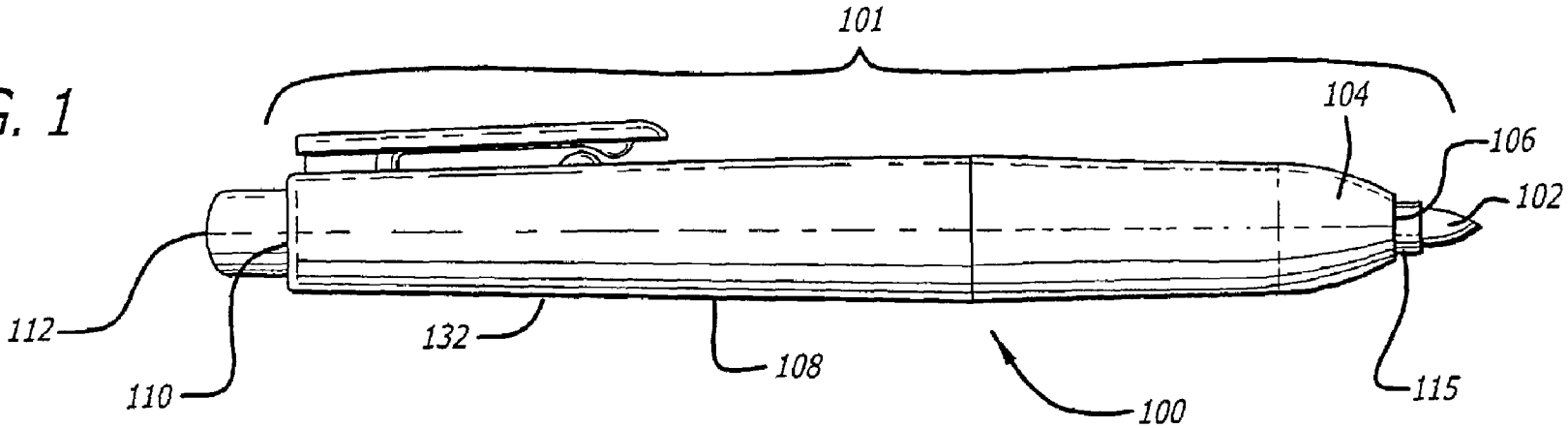
FIG. 1 illustrates a side view of a writing instrument with the tip in a protracted position.

FIG. 1 illustrates a writing instrument 100 in a protracted position. The writing instrument 100 has a housing 101 comprised of a first barrel 104 and a second barrel 108. In the protracted position, a tip 102 of the writing instrument 100 extends from the first barrel 104. The first barrel 104 has a first opening 106 at the front side to allow the tip 102 to move between the protracted position and the retracted position. The second barrel 108 has a second opening 110 at the back end to allow a plunger 112 to extend between the protracted position and the retracted position. In the protracted position, the plunger 112 is pressed down relative to the second barrel 108, which causes the tip 102 to extend through the first opening 106 and extend from the first barrel 104. A support member 115 may wrap around the side of the tip 102 in order to guide the tip 102 through the first opening 106. The first barrel 104 may reduce the diameter of the housing towards the tip 102 to form the first opening 106.

Figure 2:
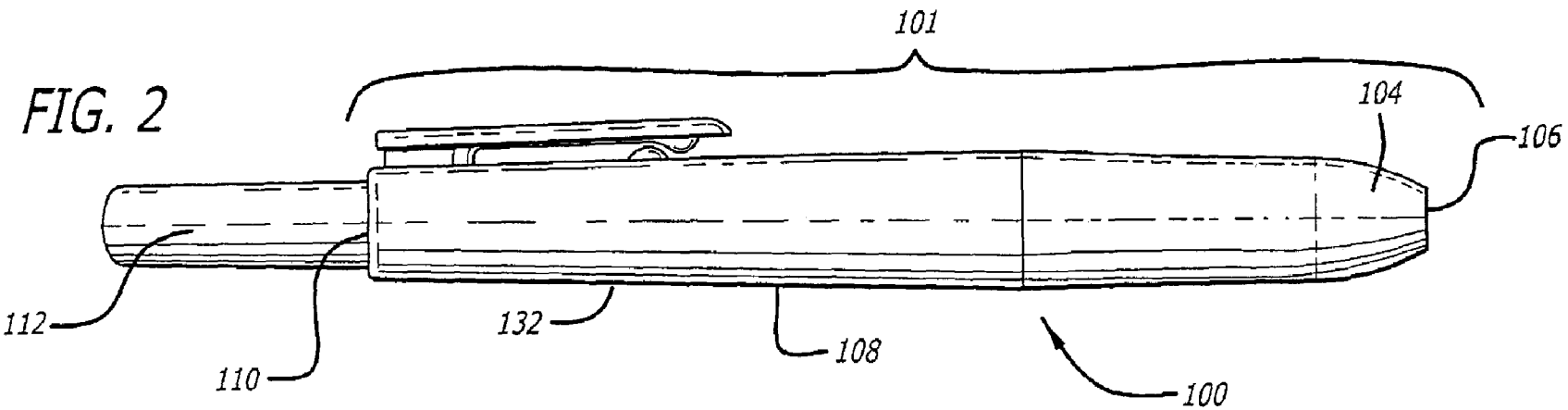
FIG. 2 illustrates a side view of the writing instrument with the tip in a retracted position.

FIG. 2 illustrates the writing instrument 100 in a retracted position where the tip 102 is inside the first barrel 104. In the retracted position, the plunger 112 further extends from the second barrel 108 that causes the tip 102 to retract into the first barrel 104 by moving back into the first opening 106. As such, activating the plunger 112 between the retracted and protracted positions causes the tip 102 to move correspondingly between the retracted and protracted positions as well. The housing 101 may be made of a unitary member as well, where the internal mechanism for the writing instrument 100 are inserted into the housing 101 through the second opening 110, or through any other alternative mechanism known to one skilled in the art.

Figure 3:
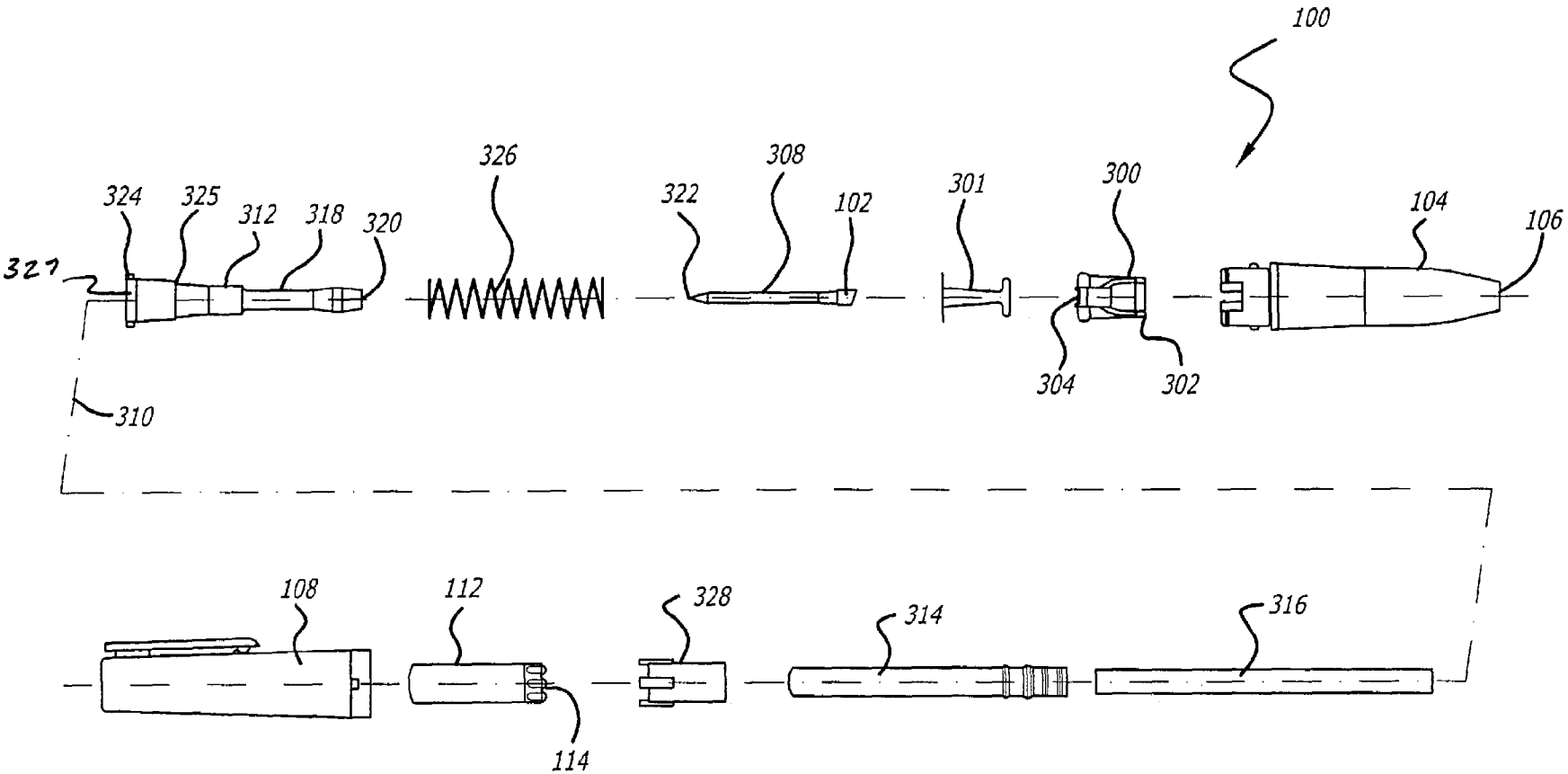
FIG. 3 illustrates a writing instrument that is disassembled.

FIG. 3 is an exploded view of the interior mechanism of the writing instrument 100. The writing instrument 100 includes an enclosure member 300 adapted to fit within the first barrel 104 adjacent to the first opening 106. The enclosure member 300 has a first end 302 and a second end 304 forming a vapor chamber within the enclosure member 300. The vapor chamber is configured to receive the tip 102 to substantially seal the tip 102 from the ambient air. In the protracted position, the first end 302 of the enclosure member 300 opens to allow the tip 102 to extend through the first opening 106. In the retracted position, the first end 302 closes to substantially seal the tip from the ambient air. The tip 102 may be coupled to a nib 308 along the longitudinal axis 310. The tip 102 may be a separate component from the nib 308 or a unitary piece.

The writing instrument 100 may include a clip 301 to aid in closing the first end 302 of the enclosure member 300. The clip 300 may be preloaded to apply compressive force on the first end 302. The enclosure member 300 may be configured so that the clip 301 may couple to the enclosure member 300 on its outer surface. In this way, the clip 301 may be disposed between the enclosing member 300 and the first barrel 104 and encircle the circumference of the second end 304 of the enclosing member 300. In addition, the second end 304 of the enclosure member 300 may have cutouts for the clip 301 so that the outer circumference of the enclosure member and the clip may combine to form the surface that contacts the inner wall of the housing 101.

The writing instrument 100 may also include a first cartridge 312 adapted to couple to a second cartridge 314. The first and second cartridges 312 and 314 are adapted to enclose a feeder 316. The feeder 316 is adapted to store writing fluid that conveys through the nib 308 and then to the tip 102. The capillary relationship among the feeder 316, nib 308, and tip 102 causes the writing fluid to convey from the feeder 316 to the tip 102. The first cartridge 312 may have an elongated portion 318 with an opening 320 adapted to receive and seal the nib 308 or tip 102. This allows the back tip 322 of the nib 308 to make contact with the feeder 316 to convey the writing fluid to the tip 102. The first cartridge 312 has a back flange 327 adapted to associate with a second cartridge member 314. The back flange 327 may have at least one tab 324 that is adapted to associate with a corresponding channel formed in the second barrel 108 so that the first cartridge 312 moves between the retracted and protracted positions without rotating. This may be done to ensure that the first cartridge moves along the axial direction 310 consistently. The elongate portion 318 of the first cartridge 312 may be inserted into the resisting member 326 such that the resisting member 326 is positioned between the second end 304 of the enclosing member 300 and the edge 325 of the first cartridge 312.

The writing instrument 100 may include a gear 328 that works with the plunger 112 and the second barrel 108 to lock the plunger 112 in the retracted position or the protracted position. The gear 328 is hollow to allow the back end of the second cartridge 314 to pass through the gear 328. The plunger 112 has a bore 114 that is adapted to receive at least a portion of the feeder 316 held within the second cartridge 314. Incorporating the feeder 316 inside the plunger 112 extends the length of the feeder 316 to store more writing fluid.

Figure 4:
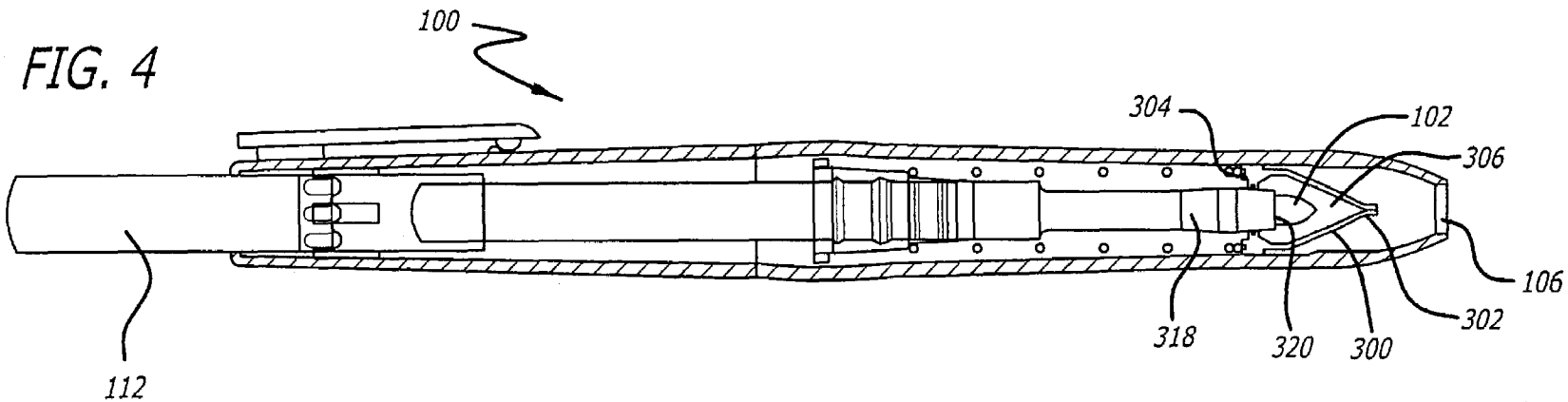
FIG. 4 is a cross-sectional view of the writing instrument in a retracted position.

FIG. 4 illustrates the cross-sectional view of the writing instrument 100 in a retracted position. In the retracted position, the tip 102 is within the vapor chamber 306 with the first end 302 forming a seal from ambient air, and the second end 304 substantially forms a seal around the elongated portion 318 so that the tip 102 extending from the opening 320 is within the vapor chamber 306 and substantially sealed from the ambient air. The back tip 322 makes contact with the feeder 316 so that the writing fluid stored in the feeder 316 conveys through the nib 308 and to the tip 102. In the retracted position, as the writing fluid evaporates from the tip 102, the vapor is substantially sealed within the vapor chamber 306. The volume in the vapor chamber 306 may be minimized to limit the evaporation of the writing fluid.

Figure 5:
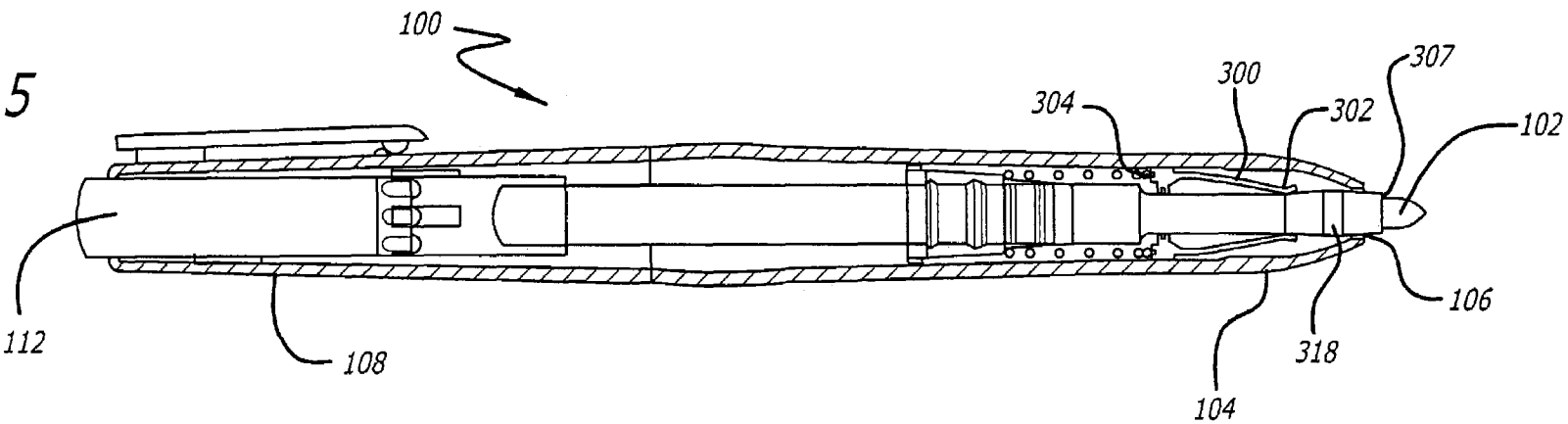
FIG. 5 is a cross-sectional view of the writing instrument in a protracted position.

FIG. 5 illustrates the writing instrument 100 in a protracted position. To write, the plunger 112 is activated or pushed towards the second barrel 108. This causes the first and second cartridges 312 and 314, the nib 308, and the tip 102 to move forward towards the first opening 106. The resisting member 326 resists against the pushing force until the gear 328 engages to lock the plunger 112 in the protracted position. As the tip 102 pushes against the first end 302, the first end 302 opens to allow the tip 102 to pass through and extend through the first opening 106. Once the tip 102 is in a protracted position, it is ready for writing onto a writing surface.

In the protracted position, the elongated portion 318 of the first cartridge 312 may extend from the first opening 106 along with the tip 102. The elongated portion 318 may assist in guiding the tip through the first end 302 of the enclosure member 300 and the first opening 106. The elongated portion 318 may have a vent 307 for allowing air into the feeder 316 when the writing instrument 100 is in use. The vent 307 may be a passage formed in the wall of the elongated portion 318, or formed between the inner wall of the elongated portion 318 and the nib 308. With the later formation of the vent 307, the size and configuration of the vent 307 may be varied by altering the outer wall configuration of the nib 308. The vent or passage may be also formed within the feeder with a certain pore size to allow air to pass to the feeder.

The elongated portion 318 may be configured so that it resides within the resisting member 326. As illustrated in FIG. 4, in the retracted position, the resisting member 326 is in an uncompressed state. As illustrated in FIG. 5, in the protracted position, the resisting member 326 is in a compression state. As the plunger 112 is activated between the retracted and protracted positions, the resisting member 326 exerts expansive force between the second end 304 of the enclosure member 300 and the edge 325 of the first cartridge 312 to cause the tip 102 to move in and out of the enclosure member 300. The plunger 112 and resisting member 326 described above may be employed in a variety of ways. For example, twist cam mechanisms and latching push button mechanisms may be used, or any other return mechanisms known to one skilled in the art.

Figure 6:
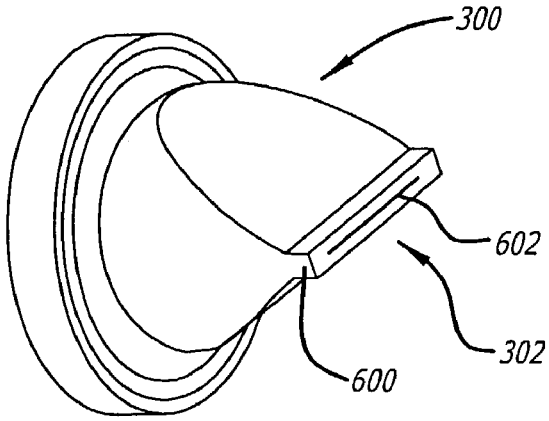
FIG. 6 is a front perspective view of an enclosure member.
Figure 7:
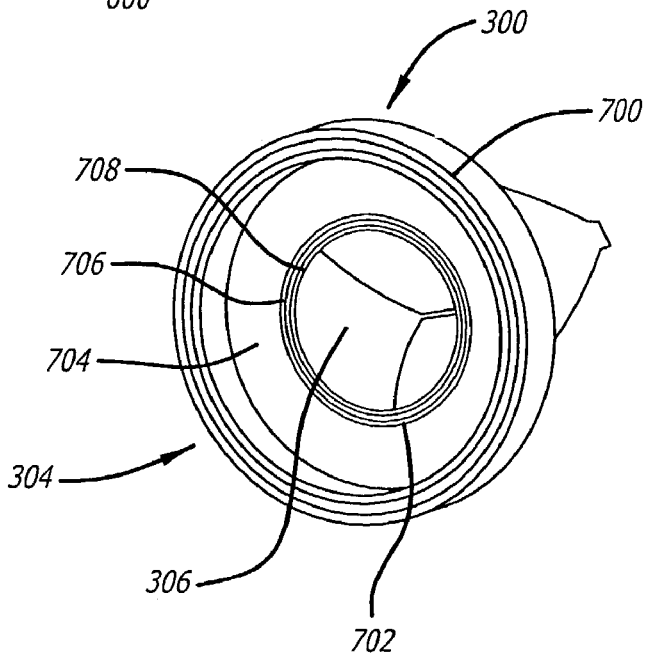
FIG. 7 is a rear perspective view of the enclosure member.

FIGS. 6 and 7 illustrate perspective views of the first end 302 and the second end 304 of the enclosure member 300. The first and second ends 302 and 304 may be integral or formed from separate pieces of elastomeric material. The first end 302 has a lip 600 with a slit 602 that opens and closes as the tip 102 moves in and out of the enclosure member 300. The elongated portion 318 may guide the tip 102 through the lip 600 as it moves through the lip 600. In the retracted position, the lip 600 substantially seals the ambient air from the vapor chamber 306 as shown in FIG. 7.

The second end 304 may have an outer configuration 700 in the form of a ring. The outer configuration may have an outer diameter sized to fit within the inner wall of the housing 101, or in the first barrel portion 104. The size of the diameter may vary so that the second end may seal around the inner wall of the housing 101, or a gap may be formed between the second end and the housing. The second end 304 may have an inner configuration 702 sized to allow the elongated portion 318 to slide forward and backwards along the longitudinal direction. The inner configuration 702 may be also sized so that it forms a substantially airtight seal around the elongated portion 318 as it slides along the longitudinal direction. This allows the vapor chamber 306 to be formed within the enclosure member 300 that is substantially sealed from the ambient air when the lip 600 is closed. In addition, the vent 307 may be formed near the tip 102 so that the enclosure member 300 may substantially seal the vent and the tip when the writing instrument 110 is in a retracted position.

The enclosure member 300 may be configured to minimize the size of the vapor chamber 306. This may be accomplished by tapering the thickness of the second wall 704 from the outer configuration 700 towards the inner configuration 702. The tapering second wall 704 may conform to provide the inner configuration that serves to guide and seal around the elongated portion 318 to minimize the space in the vapor chamber 306.

The inner configuration 702 may be configured to minimize the resistance on the elongated portion 318 as it slides back and forth. The inner configuration may have one or more edges 706 and 708 separated by a depression, reducing the thickness of the second wall 704 with every depression. Reducing the wall thickness with the edges 706 and 708 reduces the friction between the inner configuration 702 and the elongated portion 318.

FIG. 6 illustrates the front perspective view of the enclosure member 300. From the second end 304, the enclosure member 300 may be configured to taper down towards the lip 600. This may be done to minimize the space within the vapor chamber 306. The tapering may be done so that the inner wall of the enclosure member 300 substantially conforms to the shape of the tip 102 and the elongated portion 318 without touching when the writing instrument is in a retracted position. The enclosure member tapers to form the lip 600 having a slit like opening 602 that opens to allow the tip 102 to protrude out.

Figure 8:
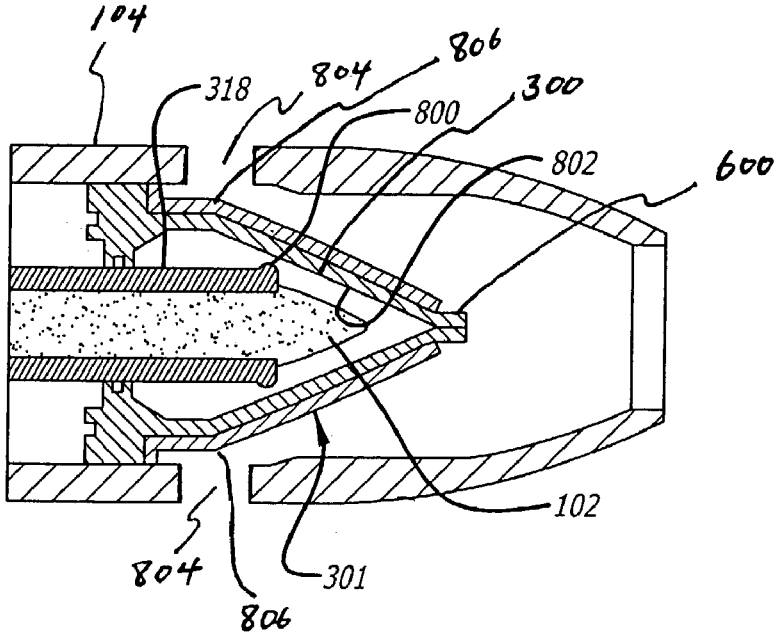
FIG. 8 is a cross-sectional view of the writing side of the writing instrument.

FIG. 8 illustrates a cross-sectional view around the first barrel 104 along with its internal mechanisms including a clip 301 over the enclosure member 300. As the elongated portion 318 moves towards the protruding position, the open end 800 of the elongated portion 318 may first engage with the inner wall 802 of the enclosure member 300 to open the lip 600 so that the tip 102 may freely extend through the lip 600. This way, the integrity and shape of the tip 102 may be maintained. The open end 800 may have a bulging configuration to further assist in pushing the lip 600 open as it engages with the inner wall 802. The first barrel 104 may also have slots 804 formed along a portion around the first barrel 104 to allow the clip 301 to open without being restrained by the inner wall of the first barrel 104. The slots 804 may be formed near the edge 806 of the clip 301 that extends out the most as the clip opens. This allows first barrel 104 to have a nominal outer configuration or minimize the diameter of the housing 101.

FIG. 9 is another cross-sectional view around the first barrel 104 where the writing instrument is in a retracted position. Here, the tip 102 extends further from the open end 900 of the elongated portion 318 so that the tip 102 may engage with the inner wall 802 of the enclosure member 300 first to open the lip 600. As the tip 102 extends further towards the protracted position, the open end 900 of the elongated portion 318 engages with the lip 600 to keep the lip opened. Note that in the retracted position, the lip 600 and the inner configuration 702 of the second end 304 substantially seal the tip 102 from the ambient air in a small space to minimize evaporation of the ink. That is, the vapor chamber 306 may be configured to seal the tip 102 with minimal volume. This may be done by providing the second end 304 adjacent to the end of the tip 102 and providing the first end adjacent to the front end of the tip 102. In addition, the second end 304 tapers towards the inner configuration 702 to provide as much distance as possible between the first end and the second end with minimal volume. The inner wall 802 may taper from the second end 304 to the first end 302 to form the lip 600 to minimize the volume of the vapor chamber 306 as well. FIG. 9 also illustrates divots 902 formed within the inner wall 904 of the first barrel 104 to allow the clip 301 to expand without being constrained by the inner wall of the first barrel 104.

The enclosure member 300 may be made of one piece as described above, or from a number of pieces. For example, the outer configuration 700 of the second end 304 may be coupled to the inner wall of the housing, and the first end 302 with the lip 600 may be coupled to the housing closer to the first opening 106, where the space between the first and second ends form the vapor chamber.

FIGS. 10 and 11 illustrate the front and rear perspective views of the clip 301, respectively. The clip 301 may include a support rim 1000, and two bias arms 1002. The support rim 1000 is configured to receive the second end 304 of the enclosure member 300. The bias arms 1002 are configured to taper towards the pinch end 1004 and house the enclosure member 300 as illustrated in FIGS. 8 and 9. The pinch end 1004 is placed over the lip 600 of the enclosure member 300 to apply compression force over the lip 600 to assist in sealing the lip 600. The bias arms 1002 may be formed from a material that is resistant to fatigue and the development of positional memory (e.g., spring steel.) The bias arms 1002 may be configured so that when it is compressing over the lip 600 in the retracted position, it may apply sufficient compression force to assist in substantially sealing the lip 600. As the elongated portion 318 engages with the inner wall of the enclosure member 300 to open the lip 600, the bias arms 1002 may release, at least, partially the compression force on the lip 600 to minimize the friction between the lip 600 and the elongated portion 318 as it moves towards the protracted position.

Figure 12:
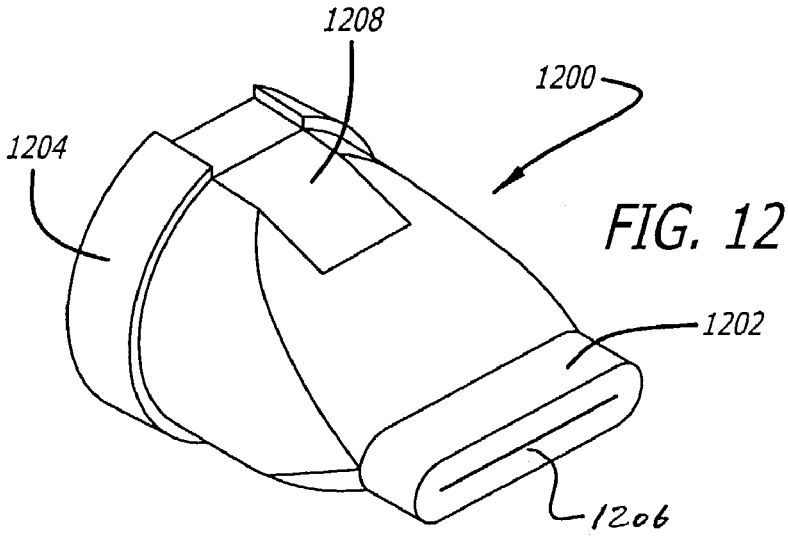
FIG. 12 is a perspective view of an alternative clip and enclosure member combination.

FIG. 12 illustrates a perspective view of another enclosure member 1200 having a first end 1202 with a lip 1206 and a second end 1204. The enclosure member 1200 may have cavities 1208, one on each side of the enclosure member 1200, adapted to receive a clip 1400 on each side as illustrated in FIG. 14, as discussed in more detail below.

Figure 13:
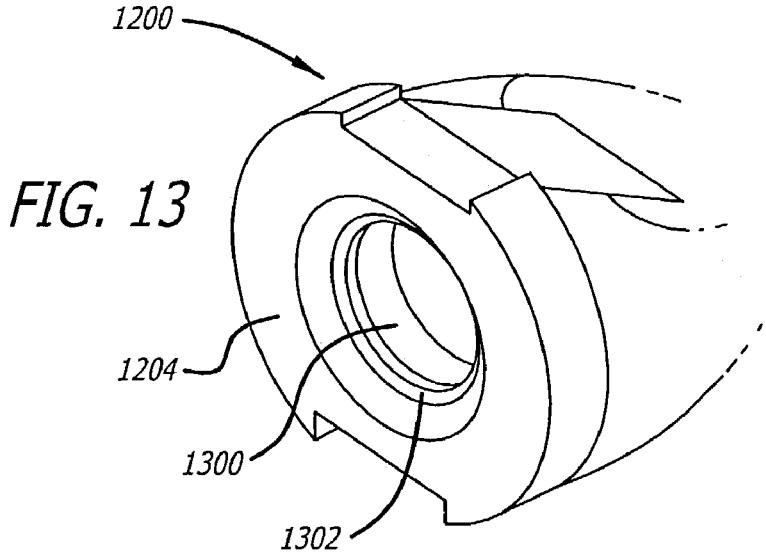
FIG. 13 is a rear perspective view of the enclosure member of FIG. 12.

FIG. 13 illustrates the perspective view of the second end 1204 of the enclosure member 1200. The second end 1204 has an inner configuration 1300 adapted to receive the elongated portion 318 with the nib 308 inside. As the tip 102 moves between the retracted and protracted positions, the elongated portion 318 correspondingly moves axially relative to the inner configuration 1300. The inner configuration 1300 substantially seals around the elongated portion 318 during this axial movement. The inner configuration 1300 may have an edge 1302 beveled to minimize the friction between the second end 1204 and the elongated portion 318. Alternatively, the inner configuration 1300 may have a rounded edge to minimize the friction with the elongated portion 318. In addition, within the inner wall of the first barrel 104 there may be channels that are aligned to associate with the cavities 1208 so that the enclosure member is properly aligned in relation to the first barrel during the assembly of the writing instrument.

Figure 14:
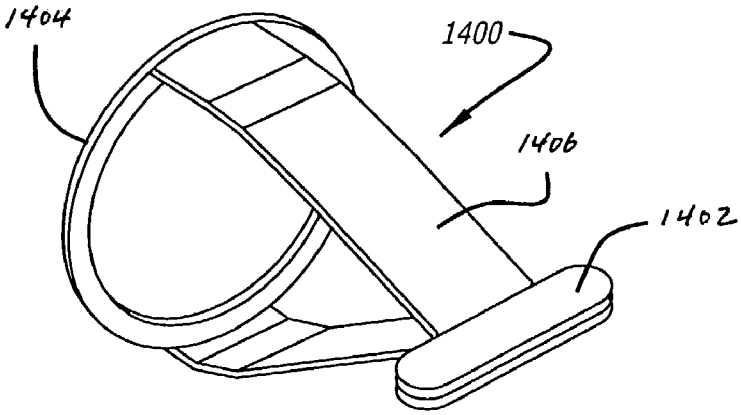
FIG. 14 is another perspective view of the clip of FIG. 12.

FIG. 14 illustrates the clip 1400 for the enclosure member 1200. The clip 1400 may be placed over the enclosure member 1200 so that the bias arms 1406 fit into the cavities 1208 formed in the enclosure member 1200. The clip 1400 has a pinch end 1402 adapted to compress the lip 1202 and the back support end 1404 on the opposite side to support the second end 1204 so that the enclosure member substantially maintains its shape as the tip moves between the retracted and protracted positions. That is, the clip 1400 may act as a back bone so that the enclosure member 1200 substantially maintains its shape as the elongated portion 318 moves back and forth along the inner configuration 1300 and the lip 1206. The width of the pinch end 1402 may cover at least the width of the slit 1206 in FIG. 12 to substantially seal the vapor formed in the vapor chamber of the enclosure member 1200 from escaping through the slit. The clip 1400 may have bias arms 1406 that are configured to provide sufficient compression force to the lip 1206 in the retracted position, but relieve at least a portion of its compression force when the tip 102 or the open end of the elongated portion 318 engages with the inner wall 802 of the enclosure member 1200. This way, the friction between the elongated portion 318 and the inner configuration 702 may be minimized so that less force is required to activate the plunger 112.

Figure 15:
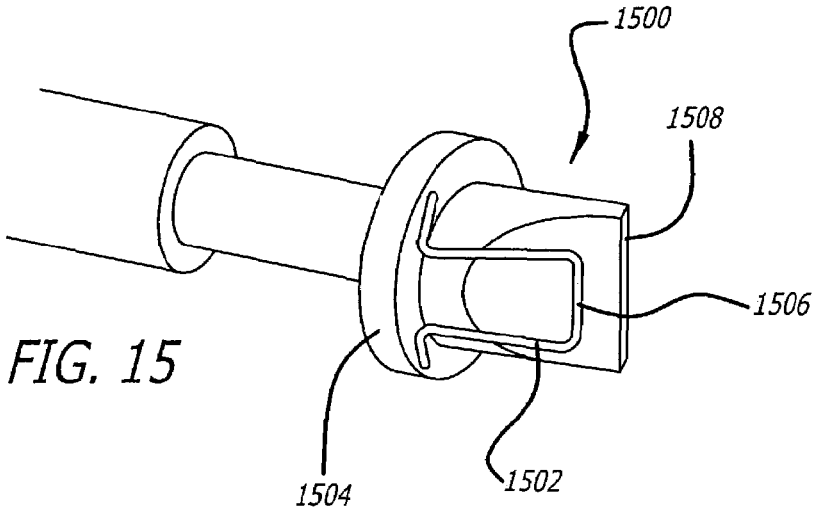
FIG. 15 is a perspective view of another clip and enclosure combination in a retracted position.

FIG. 15 illustrates an enclosure member 1500 having a clip member 1502 that is integrated into the enclosure member 1500. The clip 1502 may be formed from two separate pieces integrated into the second end 1504 of the enclosing member 1500. Each piece may have a "U" shape configuration. The clip 1502 may have a pinch end 1506 that substantially seals the lip 1508 of the enclosure member 1500 in the retracted position.

Figure 16:
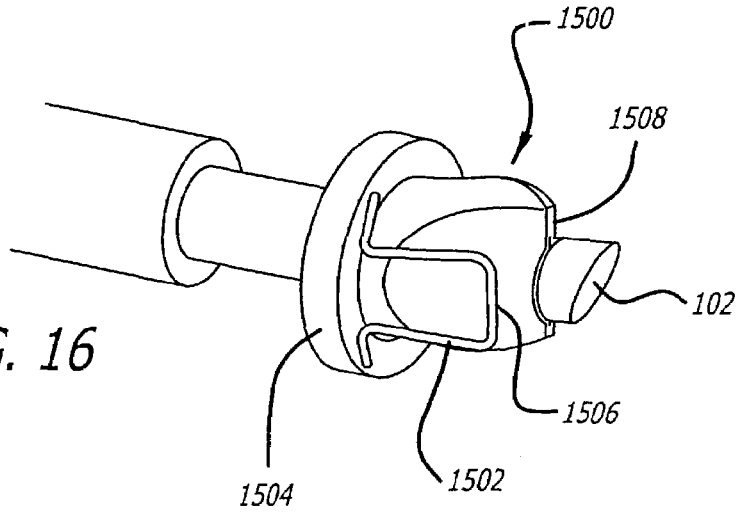
FIG. 16 is another perspective view of the clip and enclosure combination of FIG. 15 transitioning from the retracted position to the protracted position.
Figure 17:
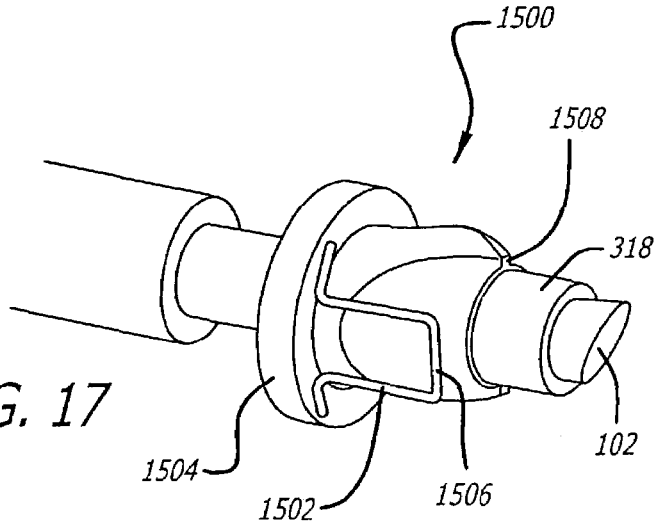
FIG. 17 is another perspective view of the clip and enclosure combination of FIG. 15 in the protracted position.

FIG. 16 illustrates the tip 102 engaging with the lip 1508 to open the lip 1508. As the tip 102 further extends towards the protracted position as illustrated in FIG. 17, the elongated portion 318 engages with the lip 1508 and keeps the lip 1508 open.

Figure 18:
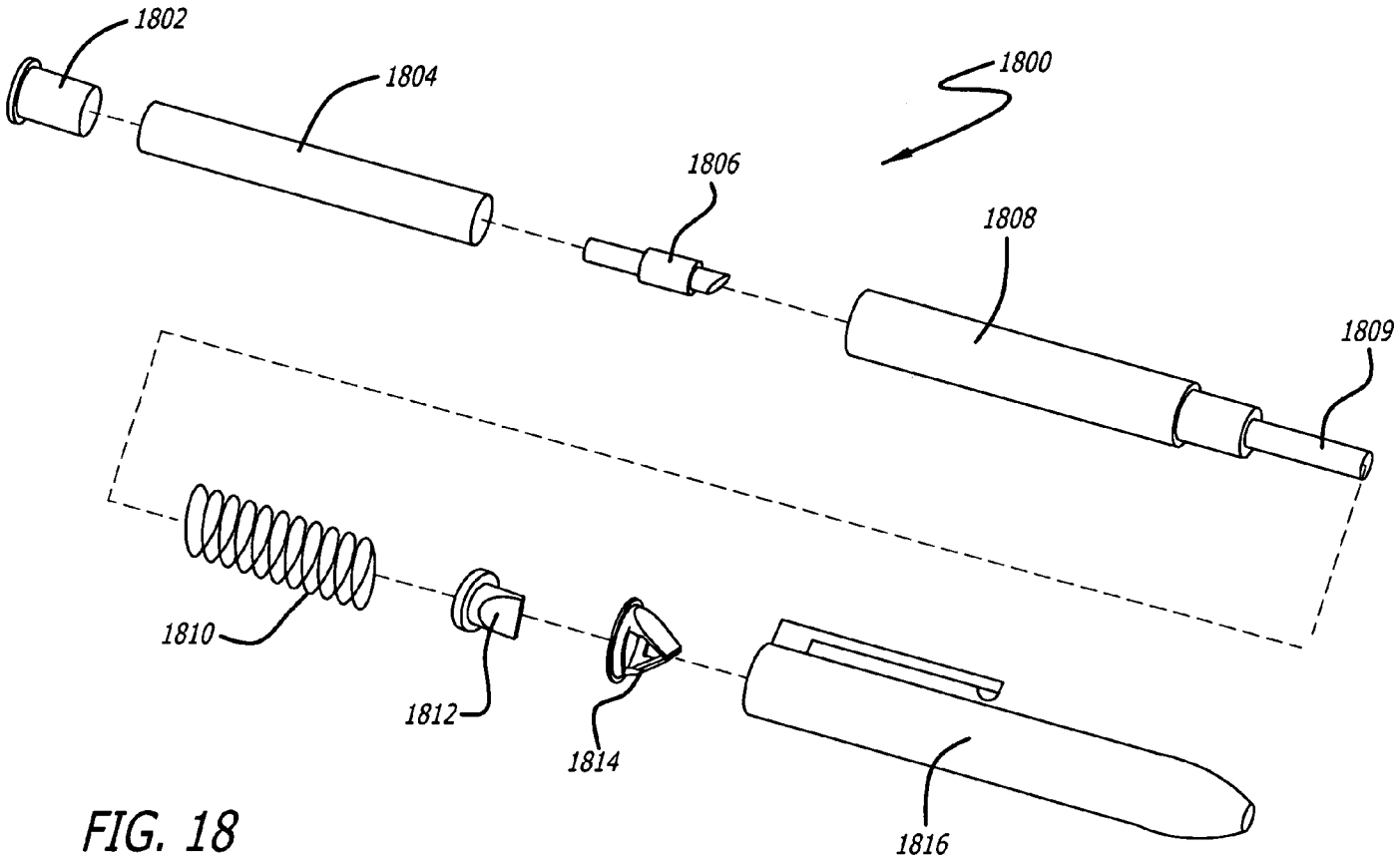
FIG. 18 is a perspective view of an alternative writing instrument that is disassembled.

FIG. 18 illustrates a disassembled perspective view of an alternative writing instrument 1800. In this example, the writing instrument 1800 includes a plunger 1802, feeder 1804, the writing tip 1806, the cartridge 1808 with an elongated portion 1809, resisting member 1810, the enclosure member 1812, the clip 1814, and the housing 1816. For assembly, the writing tip 1806 may be inserted into the cartridge 1808 followed by the feeder 1804 and the plunger 1802, which seals the back end of the cartridge 1808. The enclosure member 1812 and the clip 1814 may be assembled as discussed above, and may be disposed into the housing 1816. The resisting member 1810 may be then inserted into the housing 1816 followed by the cartridge 1808. Alternatively, bias arms 1002 may be coupled to the first barrel portion of the housing to engage with the lip of the enclosure member to assist in sealing the lip. In addition, the internal mechanism described above may be manufactured in various sizes appropriate for different diameters of the writing instrument or other non-writing devices for applying volatile liquids such as cosmetics, paint, and the like.

Figure 19:
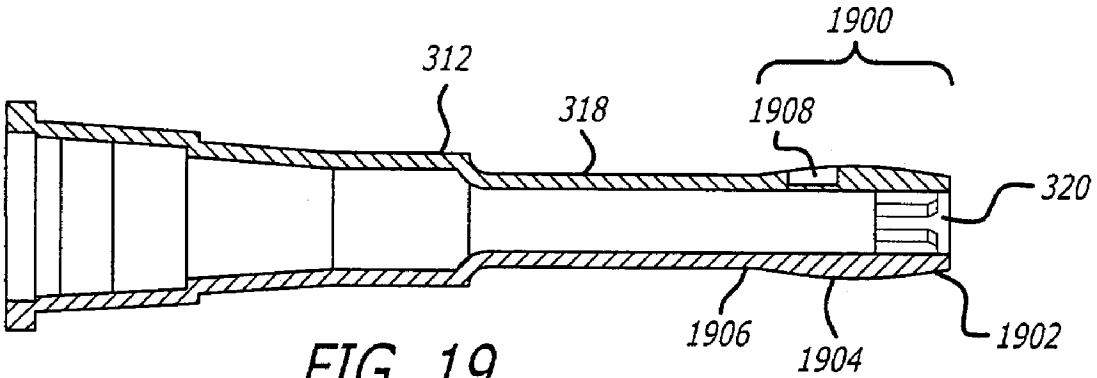
FIG. 19 is a cross-sectional view of a cartridge with an elongated portion.

FIG. 19 illustrates an enlarged cross-sectional view of the first cartridge 312. The leading section 1900 of the elongated portion 318 may have three sections, a first leading section 1902, a second leading section 1904, and a third leading section 1906, where the second leading section 1904 is between the first and third leading sections 1902 and 1906. In the retracted position, the first leading section 1902 is within the vapor chamber 306, the second leading section 1904 substantially forms a seal with the second end 304, and the third leading section 1906 is on the rear side of the second end 304. The first leading section 1902 tapers downward towards the opening 320 along the longitudinal axis to make it easier for the first leading section 1902 to pass through the slit like opening in the lip of the enclosure member. The second leading section 1904 is substantially flat along the longitudinal axis to form a seal with the inner configuration of the second end 304 in the retracted position. The circumference around the second leading section 1904 may be about the same or slightly greater than the size of the inner configuration 702 and 1300 in the second end 304 to form a seal. The third leading section 1906 tapers upward towards the opening 320 along the longitudinal axis so that as the third leading section 1906 is pushed into the second end 304, the circumference around the third leading section 1906 is reduced to minimize the friction between the third leading section 1906 and the second end 304. This in turn minimizes the wear along the inner configuration of the second end 304.

FIG. 19 also illustrates that the third leading section 1906 may have a recess area 1908 formed behind the second end 302 of the enclosure member 300 in the retracted position to control the release of vapor formed within the vapor chamber 306. In the retracted position, vapor may form within the vapor chamber 306 as writing fluid evaporates through the tip 102. As the tip 102 moves from the retracted position to the protracted position, the recess area 1908 formed in the elongated portion 318 slides into the second end 304 forming a gap between the third leading section 1906 and the inner configuration. The gap may be formed on the second end 304 before the tip 102 passes through the first end 302. As such, any vapor inside the vapor chamber 306 is released through the gap on the back side or second end 304 rather than through the slit in the lip on the front end or first end 302 of the enclosure member 300. This eliminates the potential problem of releasing vapor through the first opening 106 of the writing instrument 100, which can spray ink spots onto the writing surface.

Figure 20:
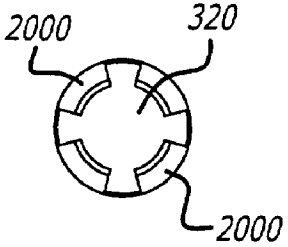
FIG. 20 is a front view of the opening in the elongated portion of FIG. 19.

FIG. 20 illustrates a front view of the opening 320 formed along the first leading section 1902. Within the opening 320 there may be at least one tooth 2000 adapted to engage with the nib 308 to hold the tip 102 in a predetermined position.

Figure 21:
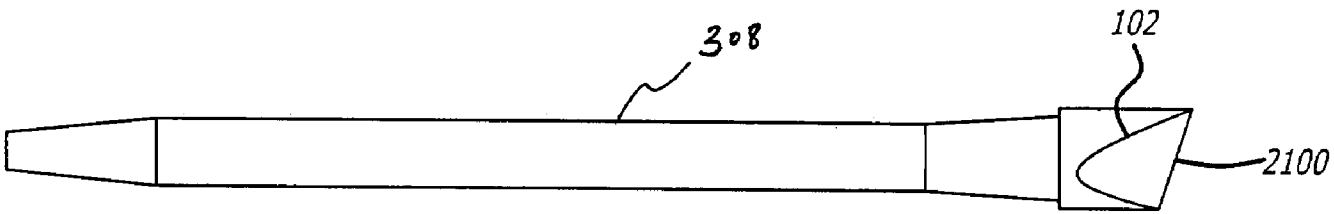
FIG. 21 is a side view of the tip and nib.

FIG. 21 shows an enlarged view of the tip 102 and the nib 308. The tip 102 may have an edge 2100 with a pitch angle to allow the tip 102 to penetrate through the slit 602 in the lip 600 more easily. The tooth 2000 inside the opening 320 may hold the tip 102 so that the edge 2100 of the tip 102 may be aligned relative to the orientation of the slit 602 on the lip 600. With the enclosure member 300 and the edge 2100 aligned and held in a predetermined position, the tip 102 may cycle in and out of the slit 602 without damaging the slit 602. This also ensures that the edge 2100 of the tip 102 protracts consistently in relation to the first and second barrels. That is, the edge of the tip 102 is substantially prevented from rotating in relation to the first and second barrels. In embodiments where the writing instrument 100 has a side clip on the second barrel or an asymmetrically shaped outer configuration, having the tip 102 protract consistently allows a user to hold the writing instrument as intended as well.

The enclosure member 300 may be made of a material that is durable and flexible so that the slit 602 does not wear out after many cycles of the tip 102 moving in and out of the slit 602. The material may have low permeability to vapor and air to seal the tip 102 from the outside air. The material may be also soft enough to provide a better seal around the imperfections in the slit and the inner configuration. In this regard, the material may have a shore hardness of about 30 to about 80, and in particular in the range of about 50 to 65. The enclosure member may be formed from a variety of materials such as silicon, butyl-rubber, and thermoplastic elastomer with thermoplastic rubber that has low-permeability to vapor. A variety of methods may be used to form the enclosure member using silicone such as injection molding, blow molding, extrusion molding, and other methods known to one skilled in the art. For alcohol-based writing fluid with higher evaporation rate, butyl rubber may be compression molded or other methods known to one skilled in the art may be used to form the enclosure member. Alternatively, the enclosure member may be formed from thermoplastic elastomer with thermoplastic rubber that has low-permeability to vapor. Such a material is manufactured by Advance Elastomer Systems, L. P. 388 South Main Street, Akron, Ohio 44311, under the name of Trefsin® that can be formed into the enclosure member 300 using a variety of methods, such as injection molding, blow molding, and extrusion molding.

Although the invention has been described with specific reference to certain exemplary embodiments, other advantages, and modifications and variations of the invention, including adaptation or incorporation of the inventive seal into writing instruments of different sizes and configurations, are all within the scope of the invention as defined by the claims and equivalents thereof.

What is claimed is:

1. A retractable writing instrument, comprising:

a housing having a first opening;

a tip capable of moving between a retracted position and a protracted position, where in the protracted position the tip extends from the first opening and in the retracted position the tip is within the housing;

a cartridge having an elongated portion for supporting the tip;

an enclosure member having a first end with a lip and a second end having an inner configuration adapted to substantially seat around the elongated portion of the cartridge, where the enclosure member is within the housing and the first end is adjacent to the first opening of the housing so that in the refracted position the tip is between the first end and the second end substantially sealed from ambient air, where in the protracted position, the tip extends through the lip of the enclosure member and the first opening of housing; and a clip having a pinch end and a support rim, where the pinch end applies compressive force to the lip to substantially seal the lip in the refracted position, the support rim of the clip supports the inner configuration of the second end of the enclosure member, and the housing has channels near the first opening and the enclosure member has cavities that associate with channels in the housing to align the enclosure member within the housing near the first opening at a predetermined position.

2. The writing instrument of claim 1, where the inner configuration has at least one edge to reduce the friction between the inner configuration and the elongated portion.

3. The writing instrument of claim 1, where the inner configuration has a beveled edge.

4. The writing instrument of claim 1, further including a vent between the tip and the elongated portion of the cartridge to allow air to pass there through, where the vent is between the first and second ends of the enclosure member in the retracted position.

5. The writing instrument of claim 1, where the elongated portion has an open end, as the writing instrument transitions from the retracted position to the protracted position the open end engages with the inner wall of the enclosure member to open the lip to allow the tip to freely protrude from the first opening.

6. The writing instrument of claim 1, where the housing has a second opening for a plunger, where activation of the plunger causes the tip to move between the retracted position and the protracted position.

7. The writing instrument of claim 6, farther including a feeder for storing writing fluid, where the feeder extends into at least a portion of the plunger.

8. The writing instrument of claim 1, where the clip has outer edges and the housing has slots near the outer edges to allow the clip to open without being restrained by the inner wall of the housing.

9. The writing instrument of claim 1, where the cartridge has at least one tab and the inner wail of the housing has a channel that receives the tab for guiding the cartridge along axially direction without rotating.

10. A retractable writing instrument capable of moving a tip between a retracted position and a protracted position from a housing to seal the tip from ambient air, the writing instrument comprising:

a clip having a pinch end and a support rim; and an enclosure member having a first end and a second end defining a vapor chamber, the support rim supporting the second end of the enclosure member, the first end having a lip and the second end having an inner configuration for enclosing the second end from ambient air, where in the retracted position the tip is within the vapor chamber and the lip with the assistance of the pinch end of the clip is substantially sealed from ambient air and the distance between the support rim of the clip and the inner configuration of the second end of the enclosure member is less than the distance between the support rim of the clip and the lip of the enclosure member, where in the protracted position the lip and the pinch end open to allow the tip to protrude from the enclosure member and the housing.

11. The writing instrument of claim 10, further including a cartridge having an elongated portion that supports due tip, where the elongated portion moves axially back and forth relative to the inner configuration as the tip moves between the retracted position and the protracted position, where the inner configuration substantially seals around the elongated portion.

12. The writing instrument of claim 11, where the inner configuration has at least one edge to reduce the friction between the inner configuration and the elongated portion.

13. The writing instrument of claim 11, where the inner configuration has a beveled edge to reduce the friction between the inner configuration and the elongated portion.

14. The writing instrument of claim 11, further including a vent between the tip and the elongated portion of the cartridge to allow air to pass there through, where the vent is within the vapor chamber in the retracted position.

15. The writing instrument of claim 11, where the elongated portion has an open end to receive the tip, as the writing instrument transitions from the retracted position to the protracted position the open end engages with the inner wall of the enclosure member to open the lip to allow the tip to freely protrude from the first opening.

16. The writing instrument of claim 11, where the elongated portion has first, second, and third leading sections, where the second leading section is between the first and third leading sections, where in the retracted position, the first leading section is within the vapor chamber, the second leading section substantially forms a seal with the inner configuration, and the third leading section is outside of the vapor chamber, where the first leading section is tapered to pass through the lip of the enclosure member with less resistance.

17. The writing instrument of claim 16, where the second leading section is substantially flat along the longitudinal axis to form a seal with the inner configuration of the enclosure member in the retracted position.

18. The writing instrument of claim 16, where the third leading section tapers upward so that as the third leading section moves into the vapor chamber the circumference around the third leading section reduces to minimize the friction between the third leading section and the inner configuration.

19. The writing instrument of claim 16, where the third leading section has a recess area so that as the tip moves from the retracted position to the protracted position, the recess area forms a gap between the third leading section and the inner configuration to relive any vapor formed in the vapor chamber.

20. The writing instrument of claim 10, further including a resisting member that applies resisting force to the second end of the enclosure member.

21. The writing instrument of claim 10, further including a cartridge having a edge and an elongated portion with an opening, where the tip is within the opening, further including a resisting member, where the elongated portion is within the resistant member and the resisting member is between the second end of the enclosure member and the edge of the cartridge.

22. The writing instrument of claim 10, where the second end of the enclosure member has an outer configuration, where the second end tapers from the outer configuration to the inner configuration to minimize the volume of the vapor chamber.

23. The writing instrument of claim 10, where the housing has channels and the enclosure member has cavities that associate with channels in the housing to align the enclosure member within the housing at a predetermined position.

24. The writing instrument of claim 10, where the housing has a second opening for a plunger, where activation of the plunger causes the tip to move between the retracted position and the protracted position.

25. The writing instrument of claim 10, where the clip has bias arms and the enclosure member has cavities adapted to receive the bias arms.

26. The writing instrument of claim 10, where the lip has a slit with a width, where the width of the pinch end is at least as wide as the width of the slit.

27. A retractable writing instrument having an enclosure member within a housing to seal a tip when the tip is within the housing, the enclosure member comprising:

a first end and a second end with an inner wall defining a vapor chamber configured to enclose a tip from ambient air when the tip is in a refracted position, where the second end has an inner configuration and an outer configuration substantially along a plane, the inner configuration adapted to substantially seal the tip and the outer configuration adapted to engage with the housing, where the inner wall tapers from the second end to the first end to form a lip that opens to allow the tip to extend through the lip in a protracted position.

28. The retractable writing instrument of claim 27, where the second end has an inner configuration and the second end tapers towards the inner configuration to minimize the volume in the vapor chamber.

29. The retractable writing instrument of claim 27, where the second end has an inner configuration with an edge.

30. A system for moving a tip of a writing system between a retracted position and a protracted position, the system comprising:

an enclosure member having a first end and a second end having an inner configuration, where the first end represents a front side, and the second end represents a rear side of the enclosure member; and a first cartridge having a leading section with an opening adapted to receive a tip, the leading section having a first leading section tapering downward towards the opening along a longitudinal axis of the first cartridge, a second leading section being substantially flat along the longitudinal axis to form a seal with the inner configuration of the second end of the enclosure member when the tip is in a retracted position such that a third leading section is on the rear side of the second end of the enclosure member, the third leading section tapering upward towards the opening so that friction between the third leading section and the inner configuration of the second end is minimized as the tip moves from the retracted position to the protracted position, and the third leading section has a recess area to form a gap between the second end and the third leading section as the third leading section moves through the hole in the second end.

31. A device for applying volatile substance, the device comprising:

a housing having a first opening and a second opening;

a tip adapted to apply volatile substance;

a cartridge having an elongated portion adapted to support the tip;

a plunger extending from the second opening of the housing and mechanically coupled to the cartridge such that actuation of the plunger causes the cartridge to move the tip between a retracted position and a protracted position, where in the refracted position the tip is within the housing, and in the protracted position the tip extends from the first opening of the housing;

an enclosure member having a first end and a second end, the second end of the enclosure member adapted to substantially seal around the cartridge, the first end of the enclosure member having a slit adapted to substantially seal the tip within the enclosure member when the cartridge is in the refracted position, and the tip extends though the slit of the enclosure member and the first opening of the housing when the cartridge is in the protracted position;

a clip adapted to apply compressive force to the first end of the enclosure member to substantially seal the slit along the first end of the enclosure member in the refracted position; and a resisting member between the second end of the enclosure member and the plunger to allow the plunger to actuate the cartridge between the refracted and protracted positions.

32. The device according to claim 31, where the volatile substance is writing liquid.

33. The device according to claim 31, where the volatile substance is cosmetic liquid.

34. The device according to claim 31, where the volatile substance is paint.

35. The device according to claim 31, including a feeder adapted to store the volatile substance, the feeder extending into at least a portion of the plunger and coupled to the tip to convey the volatile substance to the tip.

36. An applicator device, comprising:

a housing;

a tip;

a resisting member in the housing, the resisting member having a resisting member first end;

a cartridge supporting the tip;

an enclosure member having an enclosure member first end mid an enclosure member second end, the enclosure member second end having an inner configuration forming a seal with the cartridge, the inner configuration and the seal being at a location between the enclosure member first end and the resisting member first end;

a clip holding the enclosure member first end in a normal closed position;

the enclosure member first end being movable from the normal closed position to an open position when the tip is pushed thereagainst to allow the tip to be in an extended working position outside of the enclosure member and outside of the housing;

a plunger mechanically coupled to the cartridge such that actuation of the plunger causes the cartridge to move the tip between a retracted storage position and the extended working position; and the tip, when in the retracted storage position, being disposed in a chamber of the applicator device, the chamber being at least substantially sealed from ambient air and which thereby retards the drying out of the tip, the chamber being formed at least in part by the seal and by the enclosure member first end when in the normal closed position.

37. The applicator device of claim 36, where the clip has a pinch end and a support rim, the pinch end applies a compressive force to the enclosure member first end to substantially seal the enclosure member first end in the normal closed position, and the support rim supports the enclosure member second end.

38. The applicator device of claim 36, where the housing has channels near a housing opening and the enclosure member has cavities associated with the channels to align the enclosure member within the housing and proximate to the housing opening.

39. The applicator device of claim 36, further including a vent between the applicator member and the cartridge to allow air to pass therethrough, where the vent is between the enclosure member first end and the enclosure member second end when the tip is in the retracted position.

40. The applicator device of claim 36, where the housing has an opening for the plunger.

41. The applicator device of claim 36, further including a feeder for storing fluid for the tip, where the feeder extends into at least a portion of the plunger.

42. The applicator device of claim 36, where the clip has outer edges and the housing has slots near the outer edges to allow the clip to open without being restrained by an inner wall of the housing.

43. The applicator device of claim 36, where the cartridge has at least one tab and the inner wall of the housing has a channel that receives the tab for guiding the cartridge in an axial direction without rotating.

44. The applicator device of claim 36, where the resisting member biases the tip into the retracted storage position.

45. The applicator device of claim 36, where the tip is adapted to apply a volatile substance to a surface external of the applicator device.

46. The applicator device of claim 45, where the volatile substance is a writing liquid.

47. The applicator device of claim 45, where the volatile substance is a cosmetic liquid.

48. The applicator device of claim 45, where the volatile substance is a paint.

49. The applicator device of claim 45, further including a feeder adapted to store the volatile substance, the feeder extending into at least a portion of the plunger and coupled to the tip to convey the volatile substance thereto.

50. The applicator device of claim 36, where the resisting member allows the plunger to actuate the cartridge between the retracted and extended positions.

51. The applicator device of claim 36, where the tip is a marker member.

52. The applicator device of claim 36, where the tip is a writing nib.

* * * * *

UNITED STATES PATENT AND TRADEMARK OFFICE

CERTIFICATE OF CORRECTION

PATENT NO. : 7,059,796 B2
APPLICATION NO. : 10/417878
DATED : June 13, 2006
INVENTOR(S) : Lewis, Jr. et al.

It is certified that error appears in the above-identified patent and that said Letters Patent is hereby corrected as shown below:

In Column 10, Line 30, delete “seat” and add --seal--;
In Column 10, Line 33, delete “refracted” and add --retracted--;
In Column 10, Line 40, delete “refracted” and add --retracted--;
In Column 11, Line 1, delete “farther” and add --further--;
In Column 11, Line 9, delete “wail” and add --wall--;
In Column 11, Line 33, delete “due” and add --the--;
In Column 12, Line 49, delete “refracted” and add --retracted--;
In Column 13, Line 33, delete “refracted” and add --retracted--;
In Column 13, Line 38, delete “refracted” and add --retracted--;
In Column 13, Line 41, delete “refracted” and add --retracted--;
In Column 13, Line 51, delete “refracted” and add --retracted--; and
In Column 14, Line 6, delete “mid” and add --and--.

Signed and Sealed this

Nineteenth Day of December, 2006

JON W. DUDAS
*Director of the United States Patent and Trademark Office*